US009840839B1

(12) United States Patent
Jumeau

(10) Patent No.: US 9,840,839 B1
(45) Date of Patent: Dec. 12, 2017

(54) FIRE-DETECTING DEVICE

(71) Applicant: JPCI Controls (Foshan Gaoming) Co., Ltd., Gaoming, Foshan (CN)

(72) Inventor: Antoine Jumeau, Quincy Voisins (FR)

(73) Assignee: JPCI CONTROLS (FOSHAN GAOMING) CO., LTD., Gaoming, Foshan Guangdong Province (CN)

( * ) Notice: Subject to any disclaimer, the term of this patent is extended or adjusted under 35 U.S.C. 154(b) by 0 days.

(21) Appl. No.: 15/619,215

(22) Filed: Jun. 9, 2017

(30) Foreign Application Priority Data

Jun. 14, 2016 (CN) ..... 2016 2 0572015 U
Mar. 1, 2017 (CN) ..... 2017 2 0195873 U

(51) Int. Cl.
*E04B 1/94* (2006.01)
*E06B 5/16* (2006.01)
*A62C 37/48* (2006.01)

(52) U.S. Cl.
CPC ..... *E04B 1/941* (2013.01); *A62C 37/48* (2013.01); *E06B 5/167* (2013.01)

(58) Field of Classification Search
CPC . E04B 1/941; E04B 1/94; A62C 37/48; E06B 5/167
See application file for complete search history.

(56) References Cited

U.S. PATENT DOCUMENTS 461,857 A * 10/1891 Tufts ..... 49/7
1,243,690 A * 10/1917 Blauvelt ..... A62C 37/12 137/72
1,953,582 A * 4/1934 Belknap ..... A62C 37/12 169/42
2,535,368 A * 12/1950 Norcross ..... E06B 5/01 220/89.4
3,968,841 A * 7/1976 Harmathy ..... A62B 3/00 169/42
4,635,729 A * 1/1987 Harmathy ..... E04B 1/941 169/42
8,490,340 B2 * 7/2013 Hatzinikolas ..... E04B 1/94 52/232
8,490,341 B2 * 7/2013 Hatzinikolas ..... E04B 1/94 52/232

(Continued)

FOREIGN PATENT DOCUMENTS

CN 105920770 A * 9/2016

*Primary Examiner* — Rodney Mintz
(74) *Attorney, Agent, or Firm* — Muncy, Geissler, Olds & Lowe PC

(57) ABSTRACT

A fire-detecting device has first and second stressed brackets plugged together. The far ends of the first and second stressed brackets both have a towing hole. A disintegrable temperature-sensing device is between the first and second stressed brackets. First and second fixing pins are in the first and second brackets, respectively. The first fixing pin is located on one side of a free-moving piece and the second fixing pin is located on the other side thereof. A guide groove is in the first stressed bracket to correspond to the second fixing pin. A guide recess is in the second stressed bracket. A stressed shaft is in the second stressed bracket. An extension part having a stressed groove is in the first stressed bracket. When the disintegrable temperature-sensing device cracks off due to high temperature, the two stressed brackets will separate, leading to the fire dampers' shutting.

9 Claims, 6 Drawing Sheets

(56) References Cited

U.S. PATENT DOCUMENTS

| | | | | |
|---|---|---|---|---|
| 8,955,263 | B2 * | 2/2015 | Hatzinikolas | A62C 2/06 52/232 |
| 9,234,344 | B2 * | 1/2016 | Hatzinikolas | E04B 1/94 |
| 9,297,198 | B2 * | 3/2016 | Malvey | E06B 5/167 |
| 2012/0125646 | A1 * | 5/2012 | Hatzinikolas | E04B 1/94 169/48 |
| 2012/0192504 | A1 * | 8/2012 | Hatzinikolas | E04B 1/94 52/99 |
| 2012/0279143 | A1 * | 11/2012 | Hatzinikolas | A62C 2/06 52/99 |
| 2015/0059259 | A1 * | 3/2015 | Hatzinikolas | E04B 1/94 52/98 |
| 2015/0167378 | A1 * | 6/2015 | Malvey | E06B 5/167 49/141 |
| 2015/0376901 | A1 * | 12/2015 | Partridge | E04B 7/163 52/1 |

* cited by examiner

FIRE-DETECTING DEVICE

TECHNICAL FIELD

This utility model relates to a fire-detecting device, which is used in places such as louver vents, air conditioning ducts and fire dampers of a building, rolling gates of a store and inlet valves of a warehouse for flammable substances.

TECHNICAL BACKGROUND

Fire-detecting device is used in an automatic fire alarm system, to probe on spot and raise an alarm while a fire accident occurs. It plays a role of keeping the surrounding under fire surveillance. In case of fire, the device will transform some fire physical parameters, e.g. temperature, etc. into electrical signals, and then activate the fire alarm controller immediately.

In case of fire, a temperature-sensing glass pillar in a conventional fire-detecting device will crack off, and then its mechanical devices, such as springs and weights etc, will be released, leading to building's louver vents open, building's fire dampers shutting, store's rolling gates being closed and the inlet valves for warehouse of flammable substances being closed completely, and so on.

However, a spring utilized in the existing devices may be worn or deformed permanently so as to impact the mechanical properties of the fire-detecting device. Besides, when the fire-detecting device is deadlocked, it will be very inconvenient to replace the temperature-sensing glass pillar.

Most existing fire-detecting devices utilize fusible alloys as the temperature-sensing element. However, the technology of utilizing fusible alloys in the fire-detecting device will disappear in the future since RoHS restricts the use of such fusible alloys. Meanwhile most existing fire-detecting devices are not provided with failure protection, which means that the assembly inside the device cannot work properly and the detection is failure when its mechanical devices, such as springs and weights etc, are released.

SUMMARY

This invention overcomes the above drawbacks, and provides a novelty fire-detecting device, without a spring. The device can be activated sensitively, with a long service life. Besides, a temperature-sensing glass pillar in device can be replaced quickly and easily.

In order to solve the above-mentioned technical problems, the following technical solution is provided in the invention.

A novelty fire-detecting device comprises a first stressed bracket and a second stressed bracket. The first stressed bracket and the second stressed bracket are plugged together; and the far ends of the first stressed bracket and the second stressed bracket are both provided with a towing hole. A disintegrable temperature-sensing device is configured between the first stressed bracket and the second stressed bracket; and the first stressed bracket is equipped with holding components for holding an upper end of the disintegrable temperature-sensing device. A first fixing pin is configured in the first stressed bracket, and a second fixing pin is configured in the second stressed bracket; the first fixing pin and the second fixing pin are staggered each other, and a free-moving piece is arranged therebetween, wherein the first fixing pin is located on one side of the free-moving piece, adjacent to the disintegrable temperature-sensing device, while the second fixing pin is located on the other side of the free-moving piece, and the first fixing pin is placed higher than the second fixing pin. The free-moving piece is equipped with a holding component for holding a lower end of the disintegrable temperature-sensing device; a guide groove is arranged in the first stressed bracket to correspond to the second fixing pin, while a guide recess is arranged in the second stressed bracket to correspond to the first fixing pin. A stressed shaft is configured in the second stressed bracket, close to the towing hole. Corresponding to the stressed shaft, the first stressed bracket is equipped with an extension part having a stressed groove.

Further, the free-moving piece is L-shaped where a vertical portion is designed as a curve between the first fixing pin and the second fixing pin. A horizontal portion of the L-shaped free-moving piece is equipped with a holding component to hold a lower end of the disintegrable temperature-sensing device.

Further, there is an insertion hole for a fixing rod in the laterals of the second stressed bracket.

Further, there is a ventilation hole in the laterals of the second stressed bracket. Meanwhile, in the first stressed bracket, there is a ventilation groove to correspond to the ventilation hole.

Further, a replacement opening is configured at the bottom of the second stressed bracket to correspond to the holding component for holding the lower end of the disintegrable temperature-sensing device.

Further, the holding component for holding a lower end of the disintegrable temperature-sensing device is a threaded fastening fitting.

Further, threaded fastening lacquer is provided between the threaded fastening fitting and the free-moving piece.

Further, the holding components for holding a upper end of the disintegrable temperature-sensing device comprise holding parts fastened on the top of the first stressed bracket and a glass bulb protective cover mounted to the holding parts.

Further, the holding parts comprise a holding bracket and a holding hole configured above the holding bracket.

Comparing with the prior art, this invention has the following benefits:

This invention describes a fire-detecting device, the towing holes of which are all pulled by ropes; when the disintegrable temperature-sensing device cracks off due to high temperature, the fire-detecting device will be separated apart, and the ropes will move oppositely, leading to building's fire damper shutting, store's rolling gates being closed, the inlet valves for warehouse of flammable substances being closed completely, and so on; Besides, the fire-detecting device can be activated sensitively with a long service life, and it avoids the use of some alloys containing lead and cadmium, which are gradually forbidden in many countries; Furthermore, the disintegrable temperature-sensing device can be replaced easily and quickly during maintenance, and it can be controlled by temperature as a sprinkler to avoid the usage of a spring, as the spring may be worn or deformed permanently so as to impact the device to work properly. This device can also prevent the user from releasing of the device from due to improper operation. The setting of the stressed shaft and the stressed groove makes firm engagement of the first stressed bracket and the second stressed bracket, which can prevent the engagement from releasing mistakenly when the device suffers a great pulling force.

BRIEF DESCRIPTION OF THE DRAWINGS

The accompanying figures hereinafter are provided to understand/explain this invention, together with the embodiment of the invention, and not a limitation to this invention.

REFERENCE LIST

Figure 1:
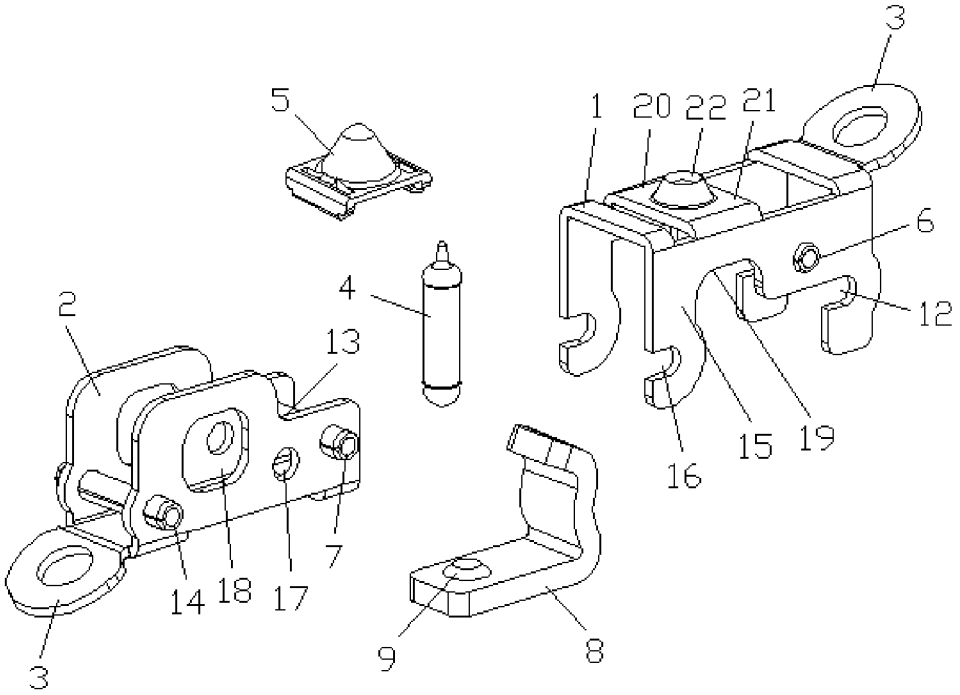
FIG. 1 is an exploded structure schematic view of a fire-detecting device according to the invention.
Figure 2:
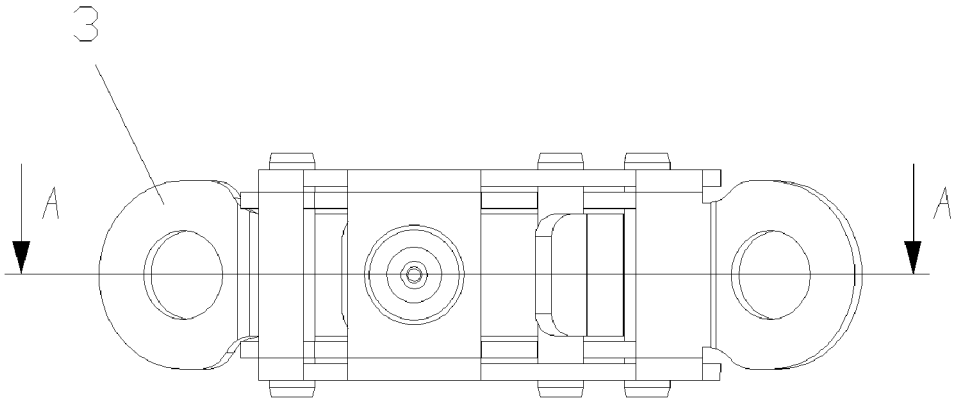
FIG. 2 is a top view of a fire-detecting device according to the invention.
Figure 3:
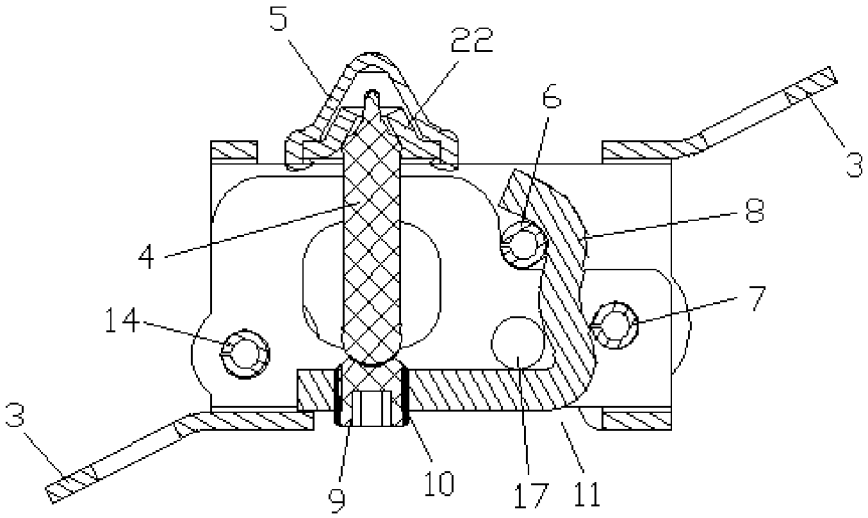
FIG. 3 is a sectional view along A-A line of FIG. 2.

1—first stressed bracket;
2—second stressed bracket;
3—towing hole;
4—temperature-sensing glass bulb;
5—glass bulb protective cover;
6—first fixing pin;
7—second fixing pin;
8—free-moving piece;
9—threaded fastening fitting;
10—threaded fastening lacquer;
11—replacement opening;
12—guide groove;
13—guide recess;
14—stressed shaft;
15—extension part;
16—stressed groove;
17—insertion hole for a fixing rod;
18—ventilation hole;
19—ventilation groove;
20—holding parts;
21—holding bracket;
22—holding hole;
23—fixing rod.

DESCRIPTION OF THE PREFERRED EMBODIMENTS

Preferred embodiment of the present invention will be described in detail hereinafter with reference to the accompanying figures. However, it should be understood that the preferred embodiment herein is only described for explaining the present invention, and it is not a limitation to the invention.

As shown in FIGS. 1-4 and 5A-5C, a novelty fire-detecting device comprises a first stressed bracket (1) and a second stressed bracket (2). The first stressed bracket (1) and the second stressed bracket (2) are plugged together, and the far ends of the first stressed bracket (1) and the second stressed bracket (2) are both provided with a towing hole (3). A disintegrable temperature-sensing device, that is a temperature-sensing glass bulb (4) here, is configured between the first stressed bracket (1) and the second stressed bracket (2), and the first stressed bracket (1) is equipped with holding components, which contains a glass bulb protective cover (5), for holding an upper end of the disintegrable temperature-sensing device. A first fixing pin is configured in the first stressed bracket (1), and a second fixing pin (7) is configured in the second stressed bracket (2). The first fixing pin (6) and second fixing pin (7) are staggered each other, and a free-moving piece (8) is arranged therebetween, wherein the first fixing pin(6) is located on one side of the free-moving piece(8), adjacent to the disintegrable temperature-sensing device, while the second fixing pin(7) is located on the other side of the free-moving piece (8), and the first fixing pin(6) is placed higher than the second fixing pin(7). The free-moving piece (8) is equipped with a holding component, which is a threaded fastening fitting (9), for holding a lower end of the disintegrable temperature-sensing device, and threaded fastening lacquer (10) is provided between the threaded fastening fitting (9) and the free-moving piece (8). A replacement opening (11) is configured at the bottom of the second stressed bracket (2), to correspond to the threaded fastening fitting (9).

The threaded fastening fitting (9) can be adjusted according to different models of the temperature-sensing glass bulb (4), to adapt to a variety of lengths and origins of the temperature sensing glass bulb (4). The disintegrable temperature-sensing device is designed to have permanent mechanical resistance to elongation over 300 DaN by using appropriate metallic raw materials and thicknesses, and to limit the permanent force on the glass bulbs to the values given by their manufacturers.

A guide groove (12), which is arranged in the first stressed bracket (1), to correspond to the second fixing pin (7), plays a guiding role, and limits the displacement of the second fixing pin (7) as well. A guide recess (13), which is arranged in the second stressed bracket (2), to correspond to the first fixing pin (6) plays a guiding role, and limits the displacement of the first fixing pin (6) as well. A stressed shaft (14) is configured in the second stressed bracket (2), close to the towing hole (3). Corresponding to the stressed shaft (14), the first stressed bracket (1) is equipped with an extension part (15) having a stressed groove (16). The first fixing pin (6), the second fixing pin (7) and the stressed shaft (14) all adopt elastic cylindrical pin. The setting of the stressed shaft and the stressed groove makes firm engagement of the first force bracket (1) and the second force bracket (2).

The free-moving piece (8) is L-shaped where a vertical portion is designed as a curve, between the first fixing pin (6) and the second fixing pin (7). In case the first force bracket (1) and the second force bracket (2) suffer strong pulling force, such curved design of the free-moving piece (8) can reduce the strength of the pulling force to pull the two brackets apart. A horizontal portion of the L-shaped free-moving piece (8) is equipped with a holding component to hold a lower end of the disintegrable temperature-sensing device. By such design of this free moving part (8) and the space between the two fixing pins, the strength applied to the temperature-sensing glass bulb (4) will be decreased progressively, which results that the novelty fire-detecting device can withstand a very strong pulling force without damaging the glass bulb.

In the laterals of the second stressed bracket (2), there are an insertion hole (17) for a fixing rod and a ventilation hole (18). Meanwhile, in the first stressed bracket (1), there is a ventilation groove (19) to correspond to the ventilation hole (18). The novelty fire-detecting device is designed to have minimal thermal inertia, which is obtained by ventilation holes and small thickness components. The ventilation hole (18) and these small thickness components of the device make the bulb (4) more temperature sensitive.

The holding components for holding the upper end of the disintegrable temperature-sensing device comprise holding parts (20) fastened on the top of the first stressed bracket (1) and a glass bulb protective cover (5) mounted to the holding parts (20), wherein the holding parts (20) comprise a holding bracket (21) and a holding hole (22) configured above the holding bracket (21), and the glass bulb protective cover (5) covers the holding hole (22). The glass bulb protective cover (5) and the holding parts (20) can be assembled conveniently.

When the temperature-sensing glass bulb (4) cracks off, the novelty fire-detecting device will be unable to keep its assembled status, instead, each component of the device will be separated apart.

Figure 4:
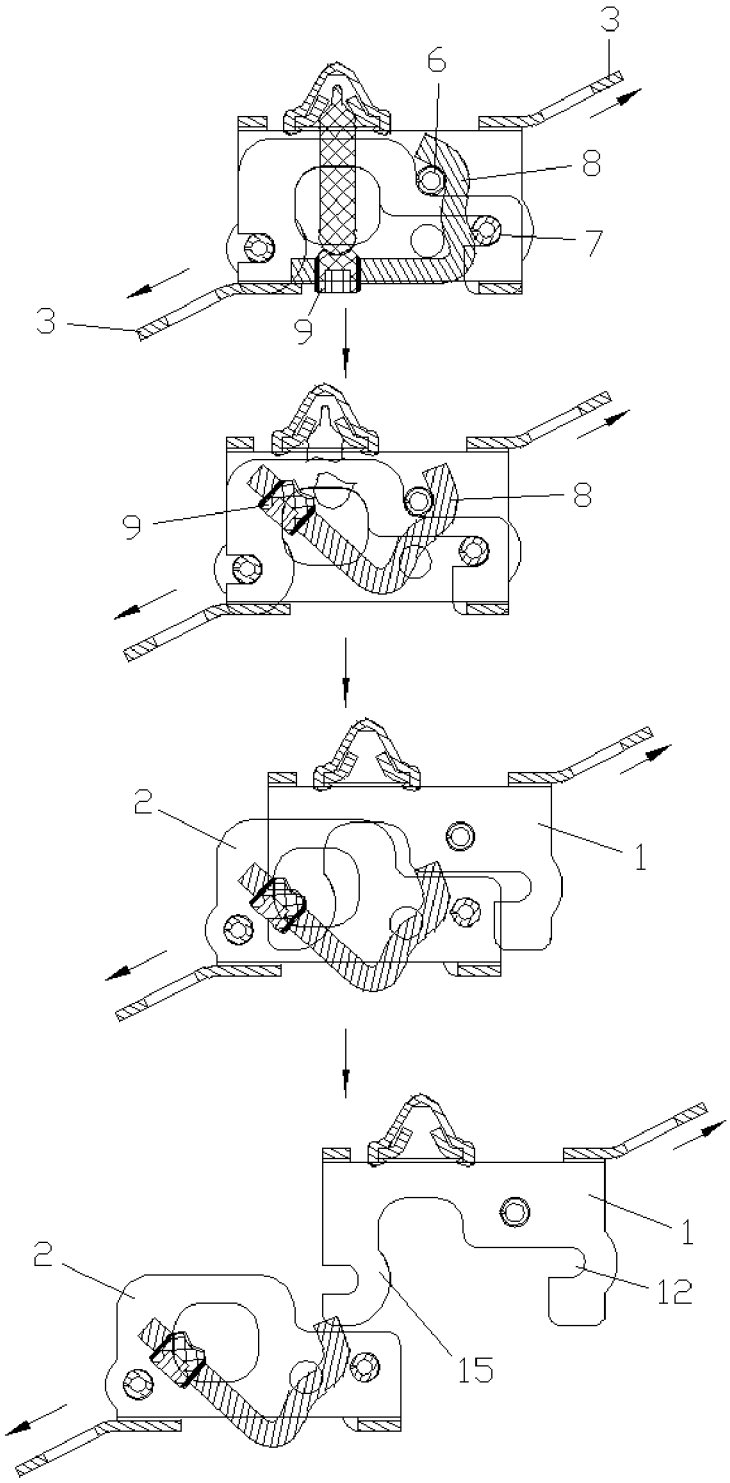
FIG. 4 are serial schematic views that show the transformation process of the fire-detecting device after a temperature-sensing glass pillar cracks off.

With reference to FIG. 4, after a temperature-sensing glass bulb (4) cracks off, the transformation of the fire-detecting device comprises the following processes.

1. When the air temperature is lower than a predetermined temperature, the temperature-sensing glass bulb (4) is kept intact, and its upper end and lower end bear against the first stressed bracket (1) and the second stressed bracket (2) respectively while two opposite pulling forces are applied to the towing holes (3) in both first and second stressed brackets;

2. When the air temperature is higher than the predetermined temperature, the temperature-sensing glass bulb (4) will crack off such that the force to bear against both first and second stressed brackets disappears. Under the two opposite pulling forces to the towing holes (3), the free-moving piece (8) are pulled to incline by the first fixing pin (6) of the first stressed bracket (1), then the first stressed bracket (1) and the second stressed bracket (2) are separated, and move oppositely.

3. The first stressed bracket (1) and the second stressed bracket (2) keep moving oppositely, resulting that the first fixing pin (6) slides out from the guide recess (13) and the second fixing pin (7) slides out from the guide groove (12), then the first stressed bracket (1) and the second stressed bracket (2) are separated completely, the free-moving piece (8) falls down and does not impact any other parts.

Figure 5A:
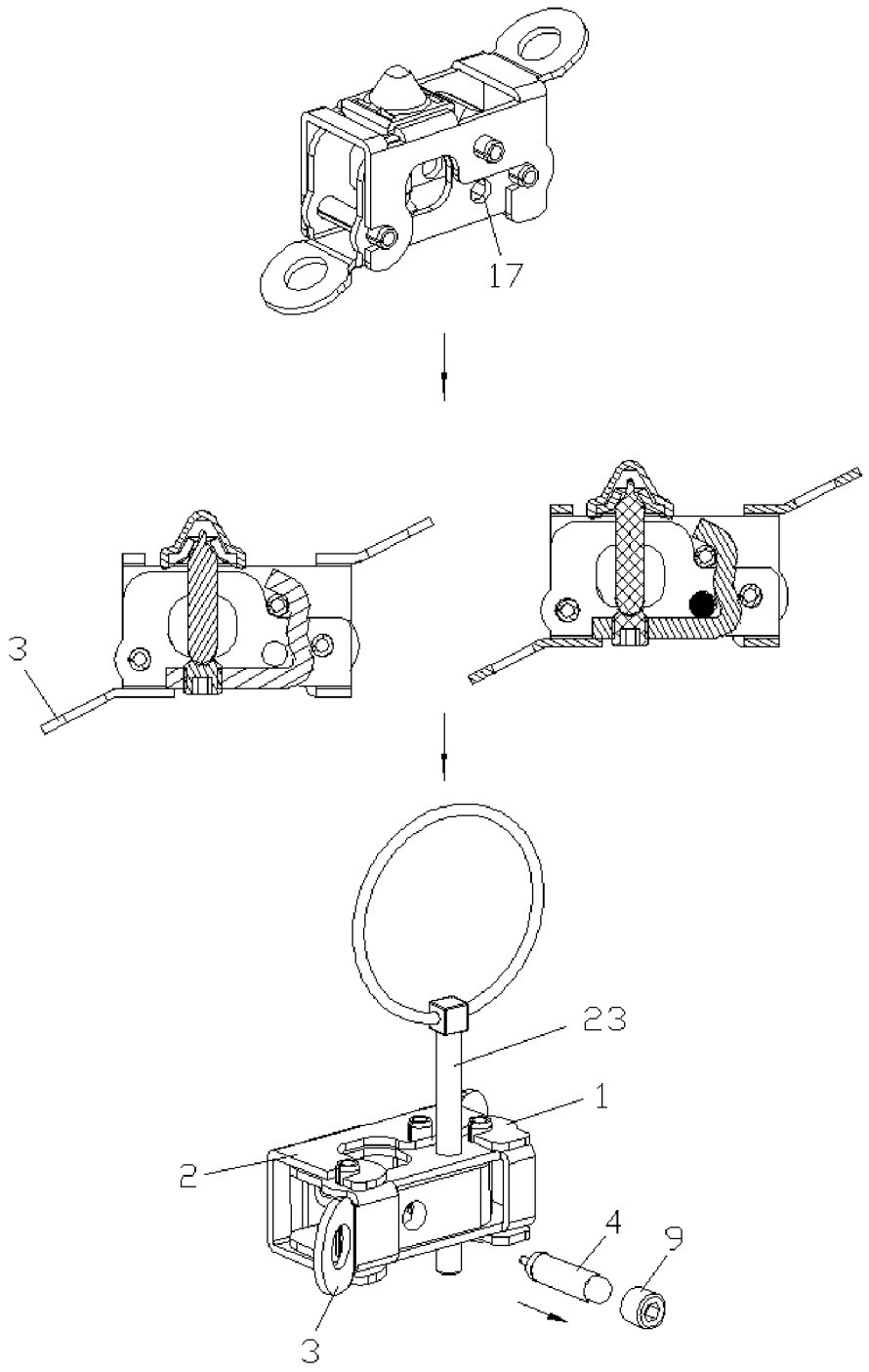
FIGS. 5A-5C are serial schematic views that show the replacement steps of the temperature-sensing glass pillar.
Figure 5B:
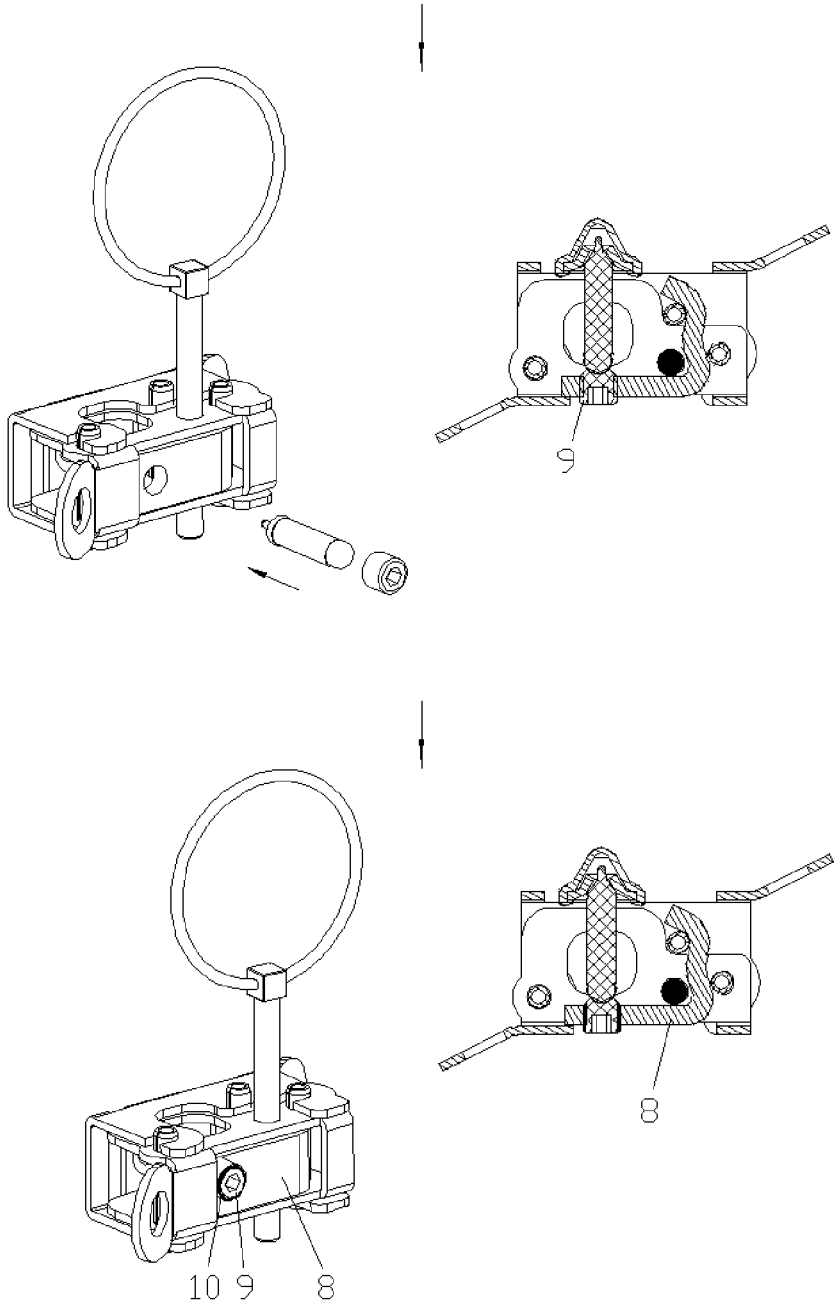
Figure 5C:
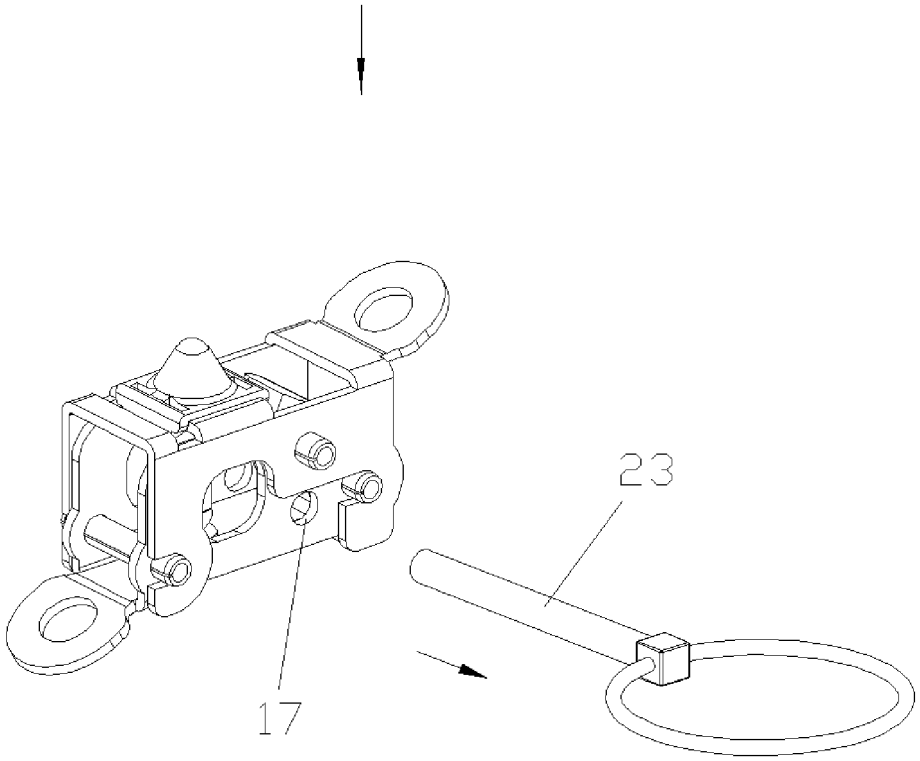

With reference to FIGS. 5A-5C, the replacement of the temperature-sensing glass bulb (4) comprises the steps of 1. Inserting a fixing rod (23) into the insertion hole (17) for securing the whole device;

2. Opening the threaded fastening fitting (9) via a replacement opening (11), then replacing the temperature-sensing glass bulb (4), fastening the threaded fastening fitting (9), and coating the threaded fastening lacquer (10), finally removing the fixing rod (23).

Please appreciate that the embodiment described hereinbefore is merely preferred embodiment of the present invention and not for purposes of any restrictions or limitations on the invention. It will be apparent that any non-substantive, obvious alterations or improvement by the technician of this technical field according to the present invention may be incorporated into ambit of claims of the present invention.

The invention claimed is:

1. A fire-detecting device, comprises a first stressed bracket and a second stressed bracket; the first stressed bracket and the second stressed bracket are plugged together, and far ends of the first stressed bracket and the second stressed bracket are both provided with a towing hole; a disintegrable temperature-sensing device is configured between the first stressed bracket and the second stressed bracket, and the first stressed bracket is equipped with holding components for holding an upper end of the disintegrable temperature-sensing device; a first fixing pin is configured in the first stressed bracket, while a second fixing pin is configured in the second stressed bracket; the first fixing pin and the second fixing pin are staggered each other, and a free-moving piece is arranged therebetween; the first fixing pin is located on one side of the free-moving piece, adjacent to the disintegrable temperature-sensing device, while the second fixing pin is located on the other side of the free-moving piece, and the first fixing pin is placed higher than the second fixing pin; the free-moving piece is equipped with a holding component for holding a lower end of the disintegrable temperature-sensing device; a guide groove is arranged in the first stressed bracket to correspond to the second fixing pin, while a guide recess is arranged in the second stressed bracket to correspond to the first fixing pin; a stressed shaft is configured in the second stressed bracket, close to the towing hole; an extension part is arranged in the first stressed bracket, to correspond to the stressed shaft, while a stressed groove is arranged in the extension part, to correspond to the stressed shaft.

2. The fire-detecting device according to claim 1, wherein the free-moving piece is L-shaped where a vertical portion thereof is designed as a curve, between the first fixing pin and the second fixing pin, while a horizontal portion thereof is equipped with a holding component to hold a lower end of the disintegrable temperature-sensing device.

3. The fire-detecting device according to claim 1, wherein an insertion hole for a fixing rod is provided in the laterals of the second stressed bracket.

4. The fire-detecting device according to claim 1, wherein a ventilation hole is provided in the laterals of the second stressed bracket, and a ventilation groove is provided in the first stressed bracket, to correspond to the ventilation hole.

5. The fire-detecting device according to claim 1, wherein a replacement opening is located at the bottom of the second stressed bracket to correspond to the holding component for holding a lower end of the disintegrable temperature-sensing device.

6. The fire-detecting device according to claim 1, wherein the holding component for holding a lower end of the disintegrable temperature-sensing device is a threaded fastening fitting.

7. The fire-detecting device according to claim 6, wherein threaded fastening lacquer is provided between the threaded fastening fitting and the free-moving piece.

8. The fire-detecting device according to claim 1, wherein the holding components for holding the upper end of the disintegrable temperature-sensing device comprise holding parts fastened on the top of the first stressed bracket and a glass bulb protective cover mounted to the holding parts.

9. The fire-detecting device according to claim 8, wherein the holding parts comprise a holding bracket and a holding hole configured above the holding bracket.

* * * * *